US006134739A

United States Patent [19]

Gonzalez

[11] Patent Number: 6,134,739

[45] Date of Patent: Oct. 24, 2000

[54] PUSH BROOM HANDLE BRACE

[76] Inventor: Daniel Gonzalez, P.O. Box 612845, San Jose, Calif. 95161

[21] Appl. No.: 09/186,244

[22] Filed: Nov. 5, 1998

[51] Int. Cl.[7] ..... B25G 3/00

[52] U.S. Cl. ..... 15/175; 15/177

[58] Field of Search ..... 15/175, 171

[56] References Cited

U.S. PATENT DOCUMENTS

| | | |
|---|---|---|
| D. 383,268 | 9/1997 | Uranga et al. . |
| D. 392,103 | 3/1998 | Zaccheria . |
| 1,134,076 | 3/1915 | Hipkins . |
| 2,903,730 | 9/1959 | Murphy . |
| 2,922,179 | 1/1960 | Lundgren . |
| 3,188,671 | 6/1965 | Kane . |
| 4,239,413 | 12/1980 | Wludyka . |
| 5,337,440 | 8/1994 | Vosbikian et al. . |
| 5,772,354 | 6/1998 | Finn . |

*Primary Examiner*—Terrence R. Till
*Assistant Examiner*—Jennifer McNeil

[57] ABSTRACT

A push broom handle brace for supporting the connection between the handle of a push broom and the broom head of the push broom. The push broom handle brace includes an elongate member having opposite first and second ends. The elongate member has spaced apart first and second middle bends defining a pair of elongate side portions and an elongate middle portion. The first and second side portions each have an end bend positioned towards the adjacent end of the elongate member. The end bend of the first side portion and the first end of the elongate member defines a first end region therebetween. The end bend of the second side portion and the second end of the elongate member defines a second end region therebetween. Each of the end regions has an aperture therethrough for extending a threaded fastener therethrough into the base block of the broom head of the push broom to couple the end regions to the base block of the broom head of the push broom. The middle portion has an arcuate bend located at the midpoint of the elongate member. The arcuate bend divides the middle portion into first and second sub-portions. First and second arm members are also provided. Each of the arm members has proximal and distal ends, proximal and distal portions and an arcuate portion interposed between the proximal and distal portions. The proximal portion of the first arm member is coupled to the first sub-portion of the middle portion of the elongate member adjacent the arcuate bend. The proximal portion of the second arm member is coupled to the second sub-portion of the middle portion of the elongate member adjacent the arcuate bend. The arcuate bend and the arcuate portions of the arm members define a generally cylindrical bore therebetween. The distal portions of the arm portions are spaced apart from each other to define an axial break therebetween into the bore. The bore is designed for receiving a handle of a push broom therein and the axial break is designed for aiding insertion of the handle into the bore.

19 Claims, 2 Drawing Sheets

PUSH BROOM HANDLE BRACE

BACKGROUND OF THE INVENTION

1. Field of the Invention

The present invention relates to push broom handle braces and more particularly pertains to a new push broom handle brace for supporting the connection between the handle of a push broom and the broom head of the push broom.

2. Description of the Prior Art

The use of push broom handle braces is known in the prior art. More specifically, push broom handle braces heretofore devised and utilized are known to consist basically of familiar, expected and obvious structural configurations, notwithstanding the myriad of designs encompassed by the crowded prior art which have been developed for the fulfillment of countless objectives and requirements.

Known prior art push broom handle braces include U.S. Pat. No. 4,239,413; U.S. Pat. No. 5,337,440; U.S. Pat. No. Des. 383,268; U.S. Pat. No. 5,568,668; U.S. Pat. No. 5,502,862; and U.S. Pat. No. 3,188,671.

While these devices fulfill their respective, particular objectives and requirements, the aforementioned patents do not disclose a new push broom handle brace. The inventive device includes an elongate member having opposite first and second ends. The elongate member has spaced apart first and second middle bends defining a pair of elongate side portions and an elongate middle portion. The first and second side portions each have an end bend positioned towards the adjacent end of the elongate member. The end bend of the first side portion and the first end of the elongate member defines a first end region therebetween. The end bend of the second side portion and the second end of the elongate member defines a second end region therebetween. Each of the end regions has an aperture therethrough for extending a threaded fastener therethrough into the base block of the broom head of the push broom to couple the end regions to the base block of the broom head of the push broom. The middle portion has an arcuate bend located at the midpoint of the elongate member. The arcuate bend divides the middle portion into first and second sub-portions. First and second arm members are also provided. Each of the arm members has proximal and distal ends, proximal and distal portions and an arcuate portion interposed between the proximal and distal portions. The proximal portion of the first arm member is coupled to the first sub-portion of the middle portion of the elongate member adjacent the arcuate bend. The proximal portion of the second arm member is coupled to the second sub-portion of the middle portion of the elongate member adjacent the arcuate bend. The arcuate bend and the arcuate portions of the arm members define a generally cylindrical bore therebetween. The distal portions of the arm portions are spaced apart from each other to define an axial break therebetween into the bore. The bore is designed for receiving a handle of a push broom therein and the axial break is designed for aiding insertion of the handle into the bore.

In these respects, the push broom handle brace according to the present invention substantially departs from the conventional concepts and designs of the prior art, and in so doing provides an apparatus primarily developed for the purpose of supporting the connection between the handle of a push broom and the broom head of the push broom.

SUMMARY OF THE INVENTION

In view of the foregoing disadvantages inherent in the known types of push broom handle braces now present in the prior art, the present invention provides a new push broom handle brace construction wherein the same can be utilized for supporting the connection between the handle of a push broom and the broom head of the push broom.

The general purpose of the present invention, which will be described subsequently in greater detail, is to provide a new push broom handle brace apparatus and method which has many of the advantages of the push broom handle braces mentioned heretofore and many novel features that result in a new push broom handle brace which is not anticipated, rendered obvious, suggested, or even implied by any of the prior art push broom handle braces, either alone or in any combination thereof.

To attain this, the present invention generally comprises an elongate member having opposite first and second ends. The elongate member has spaced apart first and second middle bends defining a pair of elongate side portions and an elongate middle portion. The first and second side portions each have an end bend positioned towards the adjacent end of the elongate member. The end bend of the first side portion and the first end of the elongate member defines a first end region therebetween. The end bend of the second side portion and the second end of the elongate member defines a second end region therebetween. Each of the end regions has an aperture therethrough for extending a threaded fastener therethrough into the base block of the broom head of the push broom to couple the end regions to the base block of the broom head of the push broom. The middle portion has an arcuate bend located at the midpoint of the elongate member. The arcuate bend divides the middle portion into first and second sub-portions. First and second arm members are also provided. Each of the arm members has proximal and distal ends, proximal and distal portions and an arcuate portion interposed between the proximal and distal portions. The proximal portion of the first arm member is coupled to the first sub-portion of the middle portion of the elongate member adjacent the arcuate bend. The proximal portion of the second arm member is coupled to the second sub-portion of the middle portion of the elongate member adjacent the arcuate bend. The arcuate bend and the arcuate portions of the arm members define a generally cylindrical bore therebetween. The distal portions of the arm portions are spaced apart from each other to define an axial break therebetween into the bore. The bore is designed for receiving a handle of a push broom therein and the axial break is designed for aiding insertion of the handle into the bore.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new push broom handle brace apparatus and method which has many of the advantages of the push broom handle braces mentioned heretofore and many novel features that result in a new push broom handle brace which is not anticipated, rendered obvious, suggested, or even implied by any of the prior art push broom handle braces, either alone or in any combination thereof.

It is another object of the present invention to provide a new push broom handle brace which may be easily and efficiently manufactured and marketed.

It is a further object of the present invention to provide a new push broom handle brace which is of a durable and reliable construction.

An even further object of the present invention is to provide a new push broom handle brace which is susceptible of a low cost of manufacture with regard to both materials and labor, and which accordingly is then susceptible of low prices of sale to the consuming public, thereby making such push broom handle brace economically available to the buying public.

Still yet another object of the present invention is to provide a new push broom handle brace which provides in the apparatuses and methods of the prior art some of the advantages thereof, while simultaneously overcoming some of the disadvantages normally associated therewith.

Still another object of the present invention is to provide a new push broom handle brace for supporting the connection between the handle of a push broom and the broom head of the push broom.

Yet another object of the present invention is to provide a new push broom handle brace which includes an elongate member having opposite first and second ends. The elongate member has spaced apart first and second middle bends defining a pair of elongate side portions and an elongate middle portion. The first and second side portions each have an end bend positioned towards the adjacent end of the elongate member. The end bend of the first side portion and the first end of the elongate member defines a first end region therebetween. The end bend of the second side portion and the second end of the elongate member defines a second end region therebetween. Each of the end regions has an aperture therethrough for extending a threaded fastener therethrough into the base block of the broom head of the push broom to couple the end regions to the base block of the broom head of the push broom. The middle portion has an arcuate bend located at the midpoint of the elongate member. The arcuate bend divides the middle portion into first and second sub-portions. First and second arm members are also provided. Each of the arm members has proximal and distal ends, proximal and distal portions and an arcuate portion interposed between the proximal and distal portions. The proximal portion of the first arm member is coupled to the first sub-portion of the middle portion of the elongate member adjacent the arcuate bend. The proximal portion of the second arm member is coupled to the second sub-portion of the middle portion of the elongate member adjacent the arcuate bend. The arcuate bend and the arcuate portions of the arm members define a generally cylindrical bore therebetween. The distal portions of the arm portions are spaced apart from each other to define an axial break therebetween into the bore. The bore is designed for receiving a handle of a push broom therein and the axial break is designed for aiding insertion of the handle into the bore.

Still yet another object of the present invention is to provide a new push broom handle brace that is easily manufactured from stamped metal so that there are few elements that can come apart from one another.

Even still another object of the present invention is to provide a new push broom handle brace that holds the handle of a push broom in place with respect to the broom head of the push broom so that the handle does not detach from the broom head and the broom head does not rotate with respect to the handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
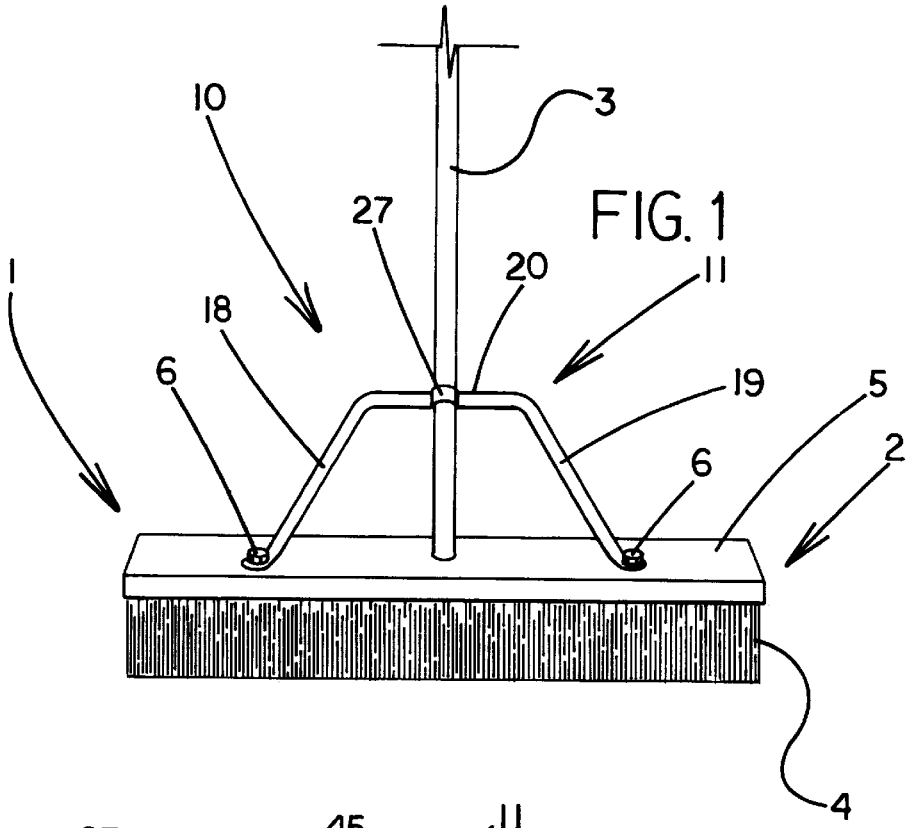
FIG. 1 is a schematic perspective view of a new push broom handle brace in use on a push broom according to the present invention.
Figure 2:
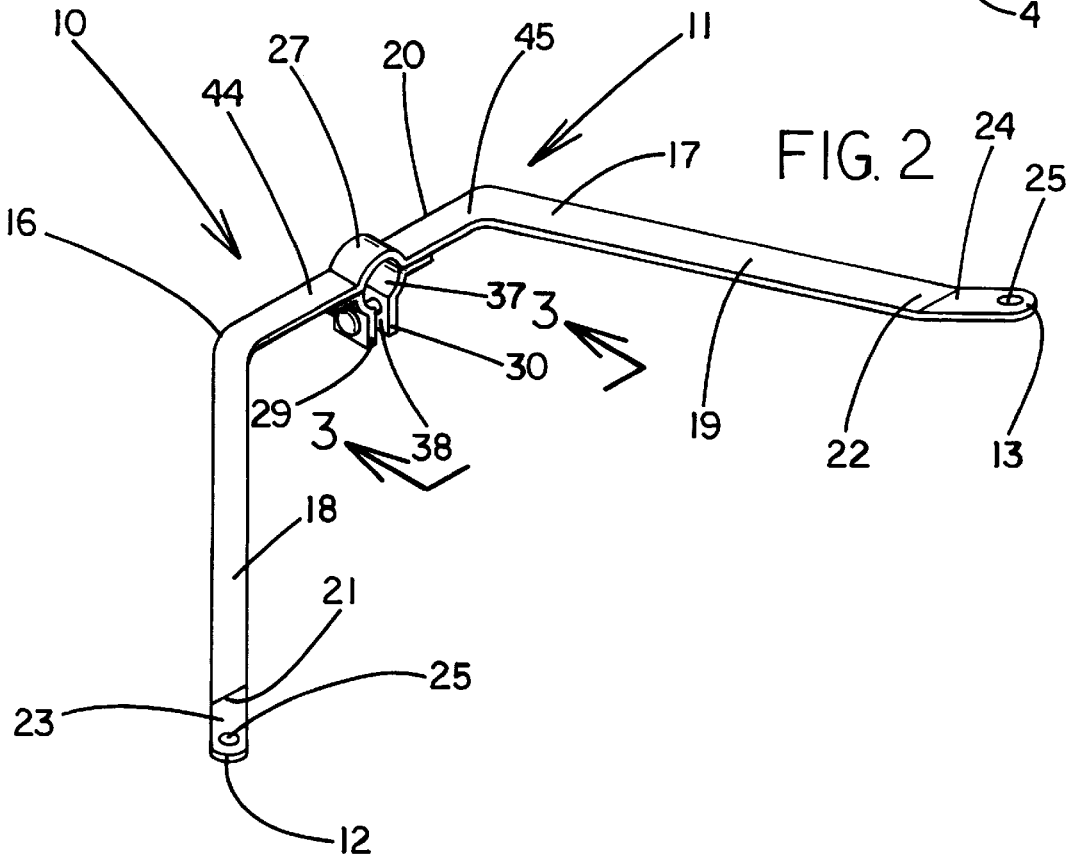
FIG. 2 is a schematic perspective view of the present invention.
Figure 3:
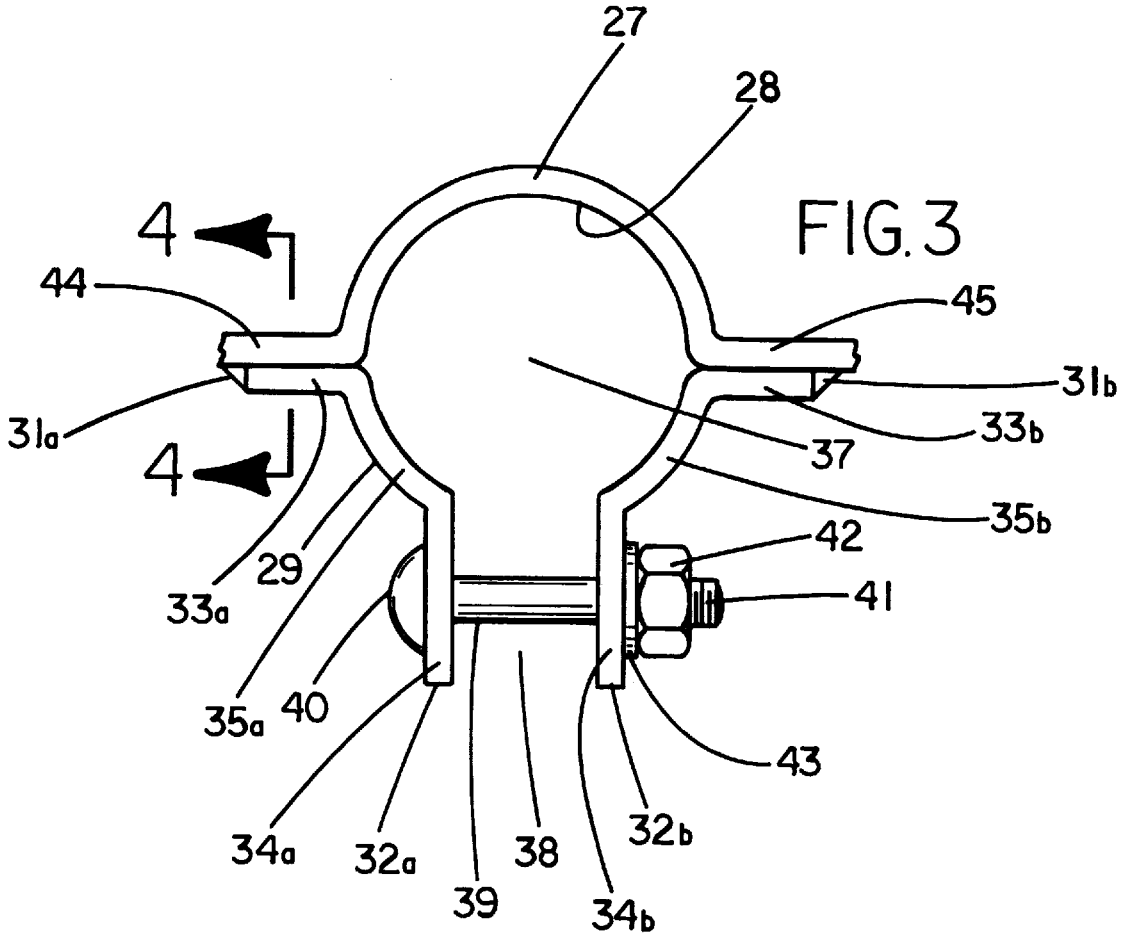
FIG. 3 is a schematic partial side view of the present invention as seen from the vantage of line 3—3 of FIG. 2.
Figure 4:
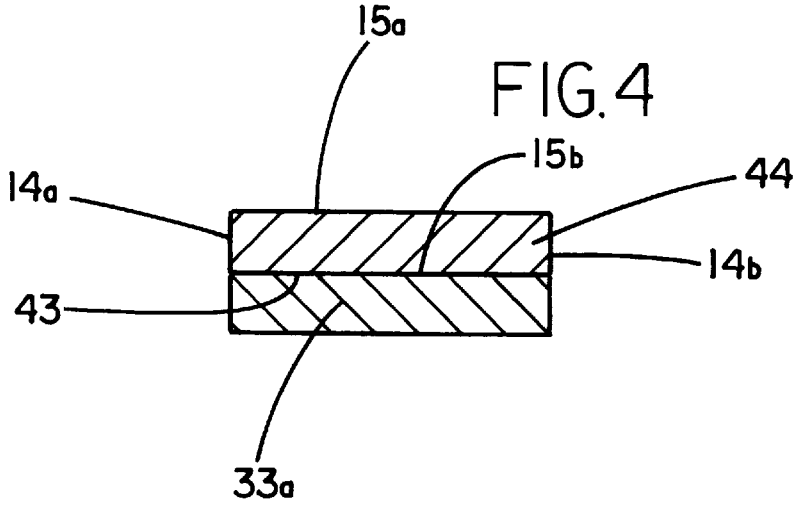
FIG. 4 is a schematic cross sectional view of the present invention taken from line 4—4 of FIG. 3.

With reference now to the drawings, and in particular to FIGS. 1 through 4 thereof, a new push broom handle brace embodying the principles and concepts of the present invention and generally designated by the reference numeral 10 will be described.

As best illustrated in FIGS. 1 through 4, the push broom handle brace 10 generally comprises an elongate member 11 having opposite first and second ends 12,13. The elongate member 11 has spaced apart first and second middle bends 16,17 defining a pair of elongate side portions 18,19 and an elongate middle portion 20. The first and second side portions 18,19 each have an end bend 21,22 positioned towards the adjacent end 12,13 of the elongate member 11. The end bend 21 of the first side portion 18 and the first end 12 of the elongate member 11 define a first end region 23 therebetween. The end bend 22 of the second side portion 19 and the second end 13 of the elongate member 11 defines a second end region 24 therebetween. Each of the end regions has an aperture 25,26 therethrough for extending a threaded fastener 6 therethrough into the base block 5 of the broom head 2 of the push broom 1 to couple the end regions 23,24 to the base block 5 of the broom head 2 of the push broom 1. The middle portion 20 has an arcuate bend 27 located at the midpoint of the elongate member 11. The arcuate bend 27 divides the middle portion 20 into first and second sub-portions 44,45. First and second arm members 29,30 are also provided. Each of the arm members 29,30 has proximal and distal ends 31*a*,31*b*,32*a*,32*b*, proximal and distal portions 33*a*,33*b*,34*a*,34*b* and an arcuate portion 35*a*,35*b* interposed between the proximal and distal portions 33*a*,33*b*, 34*a*,34*b*. The proximal portion 33*a* of the first arm member 29 is coupled to the first sub-portion 44 of the middle portion 20 of the elongate member 11 adjacent the arcuate bend 27. The proximal portion 33*b* of the second arm member 30 is coupled to the second sub-portion 45 of the middle portion 20 of the elongate member 11 adjacent the arcuate bend 27. The arcuate bend 27 and the arcuate portions 35*a*,35*b* of the arm members define a generally cylindrical bore 37 therebetween. The distal portions 34*a*,34*b* of the arm portions are spaced apart from each other to define an axial break 38 therebetween into the bore 37. The bore 37 is designed for receiving a handle 3 of a push broom 1 therein and the axial break 38 is designed for aiding insertion of the handle 3 into the bore 37.

In use, the brace 10 is designed for a push broom 1 having a broom head 2 and an elongate handle 3. The broom head 2 of the push broom 1 has a plurality of bristles 4 and a base block 5. One end of the elongate handle 3 of the push broom is threadably inserted into a threaded bore 37 in the base block 5 of the broom head 2 to couple the handle to the broom head.

In closer detail, the brace 10 comprises an elongate member 11 has opposite first and second ends 12,13 and a midpoint generally equidistant from the first and second ends 12,13 of the elongate member 11. The elongate member 11 has a generally rectangular transverse cross section defining a pair of short sides 14*a*,14*b* and pair of long sides 15*a*,15*b* extending between the short sides 14*a*,14*b* of the transverse cross section of the elongate member 11.

The elongate member 11 has spaced apart inwardly extending first and second middle bends 16,17 defining a pair of elongate side portions 18,19 and an elongate middle portion 20. The first middle bend 16 is located towards the first end 12 of the elongate member 11. The second middle bend 17 is located towards the second end 13 of the elongate member 11. A first of the side portions 18 is defined between the first end 12 of the elongate member 11 and the first middle bend 16. A second of the side portions 19 is located between the second end 13 of the elongate member 11 and the second middle bend 17. The middle portion 20 is located between the first and second middle bends 16,17. Each of the portions of the elongate member 11 has a longitudinal axis.

The first and second side portions 18,19 each have an outwardly extending end bend 21,22 positioned towards the adjacent end of the elongate member 11. The end bend 21 of the first side portion 18 and the first end 12 of the elongate member 11 define a first end region 23 therebetween. The end bend 22 of the second side portion 19 and the second end 13 of the elongate member 11 define a second end region 24 therebetween. Each of the end regions 23,24 has a generally circular aperture 25,26 therethrough. The end regions 23,24 are designed for coupling to a base block 5 of a broom head 2 of a push broom 1. Each of the apertures 25,26 of the end regions 23,24 is designed for extending a threaded fastener 6 therethrough into the base block 5 of the broom head 2 of the push broom 1 to couple the end regions to the base block 5 of the broom head 2 of the push broom 1.

The middle portion 20 has an outwardly extending arcuate bend 27 located at the midpoint of the elongate member 11. The arcuate bend 27 divides the middle portion 20 into first and second sub-portions 44,45. The arcuate bend 27 defines a generally semi-circular concave inner arcuate face 28.

First and second arm members 29,30 are also provided. Each of the arm members 29,30 is of generally equal dimensions and has proximal and distal ends 31*a*,31*b*,32*a*, 32*b*, and a generally rectangular transverse cross section about the same dimensions of the transverse cross section of the elongate member 11 (including about equal widths defined between the short sides and thickness' defined between the long sides of the respective transverse cross section). Each of the arm members 29,30 has generally straight proximal and distal portions 33*a*,33*b*,34*a*,34*b* and an arcuate portion 35*a*,35*b* interposed between the proximal and distal portions 33*a*,33*b*,34*a*,34*b*. Each of the arcuate portions 35*a*,35*b* defines an about quarter of a circumference arc concave inner arcuate face 28.

The proximal portion 33*a* of the first arm member 29 is coupled to the first sub-portion 44 of the middle portion 20 of the elongate member 11 adjacent the arcuate bend 27. The proximal portion 33*b* of the second arm member 30 is coupled to the second sub-portion 45 of the middle portion 20 of the elongate member 11 adjacent the arcuate bend 27. Preferably, a weld 36 couples each of the proximal portion 33*a*,33*bs* of the arm member to the associated sub-portion of the middle portion 20 to provide a strong and lightweight coupling of the arm members to the middle portion 20. The proximal portion 33*a*,33*bs* of the arm members preferably generally lie in generally parallel planes with the sub-portions of the middle portion 20. Preferably, each of the distal portions 34*a*,34*b* of the arm portions generally lies in a plane extending generally perpendicular to the sub-portions 44,45 of the middle portion 20.

The inner faces of the arcuate bend 27 and the arcuate portions 35*a*,35*b* of the arm members define a generally cylindrical bore 37 therebetween. The distal portions 34*a*, 34*b* of the arm portions 29,30 are spaced apart from each other to define an axial break 38 therebetween into the bore 37. In use, the bore 37 is designed for receiving a handle 3 of a push broom 1 therein such that the sub-portions 44,45 of the middle portion 20 extend generally perpendicular to the length of the handle 3 of the push broom 1. In use, the axial break 38 is designed for aiding insertion of the handle 3 into the bore 37 by permitting expansion of the relative diameter of the bore 37.

The distal portions 34*a*,34*b* of the arm members 29,30 each have a hole therethrough. The holes of the distal portions 34*a*,34*b* of the arm members are generally coaxial to one another. A bolt 39 is extended through holes of distal portions 34*a*,34*b* of arm members 29,30 across the axial break 38. The bolt 39 has a head portion 40 outwardly extended from the distal portion 34*a* of one of the arm members 29 and a threaded portion 41 outwardly extended from the distal portion 34*b* of another of the arm members 30. A nut 42 and washer 43 are threaded onto the threaded portion 41 of the bolt 39. In use, advancing the nut 42 on the threaded portion 41 of the bolt 39 squeezes the distal portions 34*a*,34*b* of the arm members 29,30 together between the nut 42 and the head portion 40 of the bolt 39 to reduce the relative diameter of the bore 37 and to hold the handle 3 of the push broom 1 in a fixed position in the bore 37.

The elongate member 11 has a width defined between the short sides 14*a*,14*b* of the transverse cross section of the elongate member 11. Ideally, the width of the elongate member 11 is about 2 cm to provide sufficient rigidity of the elongate member to withstand the stress of prolonged use of the brace 10 on the push broom 1.

The first side portion 18 has a length defined between the first end 12 of the elongate member 11 and the first middle bend 16. The second side portion 19 has a length defined between the second end 13 of the elongate member 11 and the second middle bend 17. The middle portion 20 has a length defined between the first and second middle bends 16,17. Preferably, the lengths of the first and second side portions 18,19 is generally equal to one another. In an ideal illustrative embodiment, the lengths of the side portions are each about 7¾ inches. The lengths of the first and second side portions 18,19 each are also greater than the length of the middle portion 20. Preferably, the lengths of the first and second side portions 18,19 are each between about 1.8 times the length of the middle portion 20 and about 1.4 times of the length of the middle portion 20 to provide an optimal ratio for strength for the side and middle portions to support the coupling of the handle 3 and the broom head 2 of the push broom 1. In the ideal illustrative embodiment, the length of the middle portion 20 is about 4½ inches.

The longitudinal axes of the first side portion 18 and the middle portion 20 define a first obtuse angle at the first middle portion 20. The longitudinal axes of the second side portion 19 and the middle portion 20 define a second obtuse angle at the first middle portion 20. Preferably, the first and second obtuse angles are about equal to one another. The end bend 21 of the first side portion 18 defines a third obtuse angle between the first end region 23 and the longitudinal axis of the first side portion 18. The end bend 22 of the second side portion 19 defines a fourth obtuse angle between the second end region 24 and the longitudinal axis of the second side portion 19. In a preferred embodiment, the third and fourth obtuse angles are about equal to one another to help optimize the strength coupling by the brace between the handle 3 and brush head of the push broom 1. The third and fourth obtuse angles each are ideally greater than the first and second obtuse angles to optimize the strength coupling by the brace between the handle 3 and brush head of the push broom 1.

The ends of the elongate member 11 is spaced apart from one another a distance greater than the length of the middle portion 20. Preferably, the distance between the ends of the elongate member 11 is greater than about twice the length of the middle portion 20 and less than about three times the length of the middle portion 20 to optimize the strength coupling by the brace between the handle 3 and brush head of the push broom 1. In the ideal illustrative embodiment, the distance between the ends of the elongate member 11 is about 12 inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A brace for a push broom having a broom head and an elongate handle, the broom head of the push broom having a plurality of bristles and a base block, one end of the elongate handle being threadably inserted into a threaded bore in the base block of the broom head, said brace comprising:

an elongate member having opposite first and second ends and a midpoint generally equidistant from said first and second ends of said elongate member;

said elongate member having spaced apart first and second middle bends defining a pair of elongate side portions and an elongate middle portion;

said first middle bend being located towards said first end of said elongate member, said second middle bend being located towards said second end of said elongate member;

a first of said side portions being defined between said first end of said elongate member and said first middle bend, a second of said side portions being located between said second end of said elongate member and said second middle bend, said middle portion being located between said first and second middle bends;

each of said portions of said elongate member having a longitudinal axis;

said first and second side portions each having an end bend position towards the adjacent end of said elongate member, said end bend of said first side portion and said first end of said elongate member defining a first end region therebetween, said end bend of said second side portion and said second end of said elongate member defining a second end region therebetween;

each of said end regions having an aperture therethrough, said end regions being adapted for coupling to a base block of a broom head of a push broom, each of said apertures of said end regions being adapted for extending a threaded fastener therethrough into the base block of the broom head of the push broom to couple the end regions to the base block of the broom head of the push broom;

said middle portion having an arcuate bend located at said midpoint of said elongate member, said arcuate bend dividing said middle portion into first and second sub-portions, said arcuate bend defining a generally semi-circular concave inner arcuate face;

first and second arm members, each of said arm members having proximal and distal ends;

each of said arm members having generally straight proximal and distal portions and an arcuate portion interposed between said proximal and distal portions, said arcuate portions of said arm members each having a concave inner arcuate face;

said proximal portion of said first arm member being coupled to said first sub-portion of said middle portion of said elongate member adjacent said arcuate bend, said proximal portion of said second arm member being coupled to said second sub-portion of said middle portion of said elongate member adjacent said arcuate bend;

said inner faces of said arcuate bend and said arcuate portions of said arcuate portions of said arm members defining a generally cylindrical bore therebetween;

said distal portions of said arm portions being spaced apart from each other to define an axial break therebetween into said bore;

said bore being adapted for receiving a handle of a push broom therein, said axial break being adapted for aiding insertion of the handle into said bore; and wherein said proximal portions of said arm members generally lie in generally parallel planes with said sub-portions of said middle portion, and wherein each of said distal portions of said arm portions generally lies in a plane extending generally perpendicular to said sub-portions of said middle portion.

2. The brace of claim 1, said elongate member has a width defined between said short sides of said transverse cross section of said elongate member, wherein said width of said elongate member is about 2 cm.

3. The brace of claim 1, wherein said first side portion has a length defined between said first end of said elongate member and said first middle bend, wherein said second side portion has a length defined between said second end of said elongate member and said second middle bend, wherein said middle portion has a length defined between said first and second middle bends, wherein said lengths of said first and second side portions being generally equal to one another, and wherein said lengths of said first and second side portions are each greater than said length of said middle portion.

4. The brace of claim 3, wherein said lengths of said first and second side portions are each between about 1.8 times said length of said middle portion and about 1.4 times of said length of said middle portion.

5. The brace of claim 3, wherein said lengths of said side portions are each about 7¾ inches, and wherein said length of said middle portion is about 4½ inches.

6. The brace of claim 1, wherein said longitudinal axes of said first side portion and said middle portion define a first obtuse angle at said first middle portion, said longitudinal axes of said second side portion and said middle portion defining a second obtuse angle at said first middle portion, wherein said first and second obtuse angles are about equal to one another.

7. The brace of claim 6, wherein said end bend of said first side portion defines a third obtuse angle between said first end region and said longitudinal axis of said first side portion, wherein said end bend of said second side portion defines a fourth obtuse angle between said second end region and said longitudinal axis of said second side portion, wherein said third and fourth obtuse angles are about equal to one another, and wherein said third and fourth obtuse angles are each greater than said first and second obtuse angles.

8. The brace of claim 1, wherein a weld couples each of said proximal portions of said arm member to the associated sub-portion of said middle portion.

9. The brace of claim 1, wherein said distal portions of said arm members each have a hole therethrough, said holes of said distal portions of said arm members being generally coaxial to one another, wherein a bolt is extended through holes of distal portions of arm members across said axial break, said bolt having a head portion outwardly extended from said distal portion of one of said arm members and a threaded portion outwardly extended from said distal portion of another of said arm members, and wherein a nut is threaded onto said threaded portion of said bolt, wherein advancing said nut on said threaded portion of said bolt squeezes said distal portions of said arm members together to hold the handle of the push broom in a fixed position in said bore.

10. The brace of claim 1, said ends of said elongate member being spaced apart from one another a distance greater than said length of said middle portion.

11. The brace of claim 10, wherein said distance between said ends of said elongate member is greater than about twice said length of said middle portion and less than about three times said length of said middle portion to optimize the strength coupling by the brace between the handle and brush head of the push broom.

12. A brace for a push broom having a broom head and an elongate handle, the broom head of the push broom having a plurality of bristles and a base block, one end of the elongate handle of the being threadably inserted into a threaded bore in the base block of the broom head, said brace comprising:

an elongate member having opposite first and second ends and a midpoint generally equidistant from said first and second ends of said elongate member;

said elongate member having a generally rectangular transverse cross section defining a pair of short sides and pair of long sides extending between said short sides of said transverse cross section of said elongate member;

said elongate member having a width defined between said short sides of said transverse cross section of said elongate member, wherein said width of said elongate member is about 2 cm;

said elongate member having spaced apart first and second middle bends defining a pair of elongate side portions and an elongate middle portion;

said first middle bend being located towards said first end of said elongate member, said second middle bend being located towards said second end of said elongate member;

a first of said side portions being defined between said first end of said elongate member and said first middle bend, a second of said side portions being located between said second end of said elongate member and said second middle bend, said middle portion being located between said first and second middle bends;

said first side portion having a length defined between said first end of said elongate member and said first middle bend, said second side portion having a length defined between said second end of said elongate member and said second middle bend, said middle portion having a length defined between said first and second middle bends;

said lengths of said first and second side portions being generally equal to one another;

said lengths of said first and second side portions each being greater than said length of said middle portion;

wherein said lengths of said first and second side portions are each between about 1.8 times said length of said middle portion and about 1.4 times of said length of said middle portion to provide an optimal ratio for strength for the side and middle portions;

each of said portions of said elongate member having a longitudinal axis;

said longitudinal axes of said first side portion and said middle portion defining a first obtuse angle at said first middle portion, said longitudinal axes of said second side portion and said middle portion defining a second obtuse angle at said first middle portion;

wherein said first and second obtuse angles are about equal to one another;

said first and second side portions each having an end bend position towards the adjacent end of said elongate member, said end bend of said first side portion and said first end of said elongate member defining a first end region therebetween, said end bend of said second side portion and said second end of said elongate member defining a second end region therebetween;

said end bend of said first side portion defining a third obtuse angle between said first end region and said longitudinal axis of said first side portion, said end bend of said second side portion defining a fourth obtuse angle between said second end region and said longitudinal axis of said second side portion;

wherein said third and fourth obtuse angles are about equal to one another;

said third and fourth obtuse angles each being greater than said first and second obtuse angles;

each of said end regions having a generally circular aperture therethrough, said end regions being adapted for coupling to a base block of a broom head of a push broom, each of said apertures of said end regions being adapted for extending a threaded fastener therethrough into the base block of the broom head of the push broom to couple the end regions to the base block of the broom head of the push broom;

said middle portion having an arcuate bend located at said midpoint of said elongate member, said arcuate bend dividing said middle portion into first and second sub-portions, said arcuate bend defining a generally semi-circular concave inner arcuate face;

first and second arm members, each of said arm members being of generally equal dimensions and having proximal and distal ends, and a generally rectangular transverse cross section;

each of said arm members having generally straight proximal and distal portions and an arcuate portion interposed between said proximal and distal portions, said arcuate portions of said arm members each having a concave inner arcuate face;

said proximal portion of said first arm member being coupled to said first sub-portion of said middle portion of said elongate member adjacent said arcuate bend, said proximal portion of said second arm member being coupled to said second sub-portion of said middle portion of said elongate member adjacent said arcuate bend, wherein a weld couples each of said proximal portions of said arm member to the associated sub-portion of said middle portion;

said proximal portions of said arm members generally lying in generally parallel planes with said sub-portions of said middle portion;

each of said distal portions of said arm portions generally lying in a plane extending generally perpendicular to said sub-portions of said middle portion;

said inner faces of said arcuate bend and said arcuate portions of said arcuate portions of said arm members defining a generally cylindrical bore therebetween;

said distal portions of said arm portions being spaced apart from each other to define an axial break therebetween into said bore;

said bore being adapted for receiving a handle of a push broom therein, said axial break being adapted for aiding insertion of the handle into said bore;

said distal portions of said arm members each having a hole therethrough, said holes of said distal portions of said arm members being generally coaxial to one another;

a bolt being extended through holes of distal portions of arm members across said axial break, said bolt having a head portion outwardly extended from said distal portion of one of said arm members and a threaded portion outwardly extended from said distal portion of another of said arm members;

a nut being threaded onto said threaded portion of said bolt, wherein advancing said nut on said threaded portion of said bolt squeezes said distal portions of said arm members together to hold the handle of the push broom in a fixed position in said bore; and said ends of said elongate member being spaced apart from one another a distance greater than said length of said middle portion, wherein said distance between said ends of said elongate member is greater than about twice said length of said middle portion and less than about three times said length of said middle portion.

13. A brace for a push broom having a broom head and an elongate handle, the broom head of the push broom having a plurality of bristles and a base block, one end of the elongate handle of the being threadably inserted into a threaded bore in the base block of the broom head, said brace comprising:

an elongate member having opposite first and second ends and a midpoint generally equidistant from said first and second ends of said elongate member;

said elongate member having spaced apart first and second middle bends defining a pair of elongate side portions and an elongate middle portion;

said first middle bend being located towards said first end of said elongate member, said second middle bend being located towards said second end of said elongate member;

a first of said side portions being defined between said first end of said elongate member and said first middle bend, a second of said side portions being located between said second end of said elongate member and said second middle bend, said middle portion being located between said first and second middle bends;

each of said portions of said elongate member having a longitudinal axis;

said first and second side portions each having an end bend position towards the adjacent end of said elongate member, said end bend of said first side portion and said first end of said elongate member defining a first end region therebetween, said end bend of said second side portion and said second end of said elongate member defining a second end region therebetween;

each of said end regions having an aperture therethrough, said end regions being adapted for coupling to a base block of a broom head of a push broom, each of said apertures of said end regions being adapted for extending a threaded fastener therethrough into the base block of the broom head of the push broom to couple the end regions to the base block of the broom head of the push broom;

said middle portion having an arcuate bend located at said midpoint of said elongate member, said arcuate bend dividing said middle portion into first and second sub-portions, said arcuate bend defining a generally semi-circular concave inner arcuate face;

first and second arm members, each of said arm members having proximal and distal ends;

each of said arm members having generally straight proximal and distal portions and an arcuate portion interposed between said proximal and distal portions, said arcuate portions of said arm members each having a concave inner arcuate face;

said proximal portion of said first arm member being coupled to said first sub-portion of said middle portion of said elongate member adjacent said arcuate bend, said proximal portion of said second arm member being coupled to said second sub-portion of said middle portion of said elongate member adjacent said arcuate bend;

said inner faces of said arcuate bend and said arcuate portions of said arcuate portions of said arm members defining a generally cylindrical bore therebetween;

said distal portions of said arm portions being spaced apart from each other to define an axial break therebetween into said bore;

said bore being adapted for receiving a handle of a push broom therein, said axial break being adapted for aiding insertion of the handle into said bore; and wherein said distal portions of said arm members each have a hole therethrough, said holes of said distal portions of said arm members being generally coaxial to one another, wherein a bolt is extended through holes of distal portions of arm members across said axial break, said bolt having a head portion outwardly extended from said distal portion of one of said arm members and a threaded portion outwardly extended from said distal portion of another of said arm members, and wherein a nut is threaded onto said threaded portion of said bolt, wherein advancing said nut on said threaded portion of said bolt squeezes said distal portions of said arm members together to hold the handle of the push broom in a fixed position in said bore.

14. The brace of claim 13, wherein said first side portion has a length defined between said first end of said elongate member and said first middle bend, wherein said second side portion has a length defined between said second end of said elongate member and said second middle bend, wherein said middle portion has a length defined between said first and second middle bends, wherein said lengths of said first and second side portions being generally equal to one another, and wherein said lengths of said first and second side portions are each greater than said length of said middle portion.

15. The brace of claim 13, wherein said longitudinal axes of said first side portion and said middle portion define a first obtuse angle at said first middle portion, said longitudinal axes of said second side portion and said middle portion defining a second obtuse angle at said first middle portion, wherein said first and second obtuse angles are about equal to one another.

16. The brace of claim 15, wherein said end bend of said first side portion defines a third obtuse angle between said first end region and said longitudinal axis of said first side portion, wherein said end bend of said second side portion defines a fourth obtuse angle between said second end region and said longitudinal axis of said second side portion, wherein said third and fourth obtuse angles are about equal to one another, and wherein said third and fourth obtuse angles are each greater than said first and second obtuse angles.

17. The brace of claim 13, wherein a weld couples each of said proximal portions of said arm member to the associated sub-portion of said middle portion.

18. The brace of claim 13, said ends of said elongate member being spaced apart from one another a distance greater than said length of said middle portion.

19. The brace of claim 18, wherein said distance between said ends of said elongate member is greater than about twice said length of said middle portion and less than about three times said length of said middle portion to optimize the strength coupling by the brace between the handle and brush head of the push broom.

* * * * *